US010167584B2

(12) United States Patent
Tashiro et al.

(10) Patent No.: US 10,167,584 B2
(45) Date of Patent: Jan. 1, 2019

(54) SEWING MACHINE

(71) Applicant: BROTHER KOGYO KABUSHIKI KAISHA, Nagoya-shi, Aichi-ken (JP)

(72) Inventors: Noriharu Tashiro, Nagoya (JP); Satomi Yamamoto, Okazaki (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/460,287

(22) Filed: Mar. 16, 2017

(65) Prior Publication Data

US 2017/0183799 A1 Jun. 29, 2017

Related U.S. Application Data

(63) Continuation of application No. PCT/JP2016/051661, filed on Jan. 21, 2016.

(30) Foreign Application Priority Data

Feb. 5, 2015 (JP) ..... 2015-020795

(51) Int. Cl.
*D05B 19/12* (2006.01)
*D05B 35/12* (2006.01)
(Continued)

(52) U.S. Cl.
CPC ..... *D05B 19/12* (2013.01); *D05B 35/12* (2013.01); *D05B 81/00* (2013.01); *D05C 7/04* (2013.01);
(Continued)

(58) Field of Classification Search
CPC ..... D05B 19/00; D05B 19/02; D05B 19/08; D05B 19/10; D05B 19/12; D05C 7/04; D05C 7/08
See application file for complete search history.

(56) References Cited

U.S. PATENT DOCUMENTS 4,998,489 A * 3/1991 Hisatake ..... D05B 19/08 112/103
5,072,680 A * 12/1991 Nakashima ..... D05B 19/12 112/445
(Continued)

FOREIGN PATENT DOCUMENTS

JP S63-120096 A 5/1988
JP H05-48875 U 6/1993
(Continued)

OTHER PUBLICATIONS

International Search Report issued in the corresponding International Application No. PCT/JP2016/051661 dated Apr. 5, 2016.
(Continued)

*Primary Examiner* — Nathan Durham
(74) *Attorney, Agent, or Firm* — K&L Gates LLP

(57) ABSTRACT

A sewing machine includes a sewing portion, a processor, and a memory. The sewing portion is configured to sew a pattern on a sewing object. The memory storing computer-readable instructions that, when executed by the processor, perform the processes. The processes include the acquiring reference data representing a relative positional relationship between a sewing position and an arrangement position. The sewing position is a position of the pattern sewn on the sewing object by the sewing portion. The arrangement position is a position of a decorative component arranged on the sewing object. The processes include displaying, on the basis of the acquired reference data, a mark that indicates the arrangement position corresponding to the sewing position.

9 Claims, 11 Drawing Sheets

(51) Int. Cl.

| | |
|---|---|
| ***D05B 81/00*** | (2006.01) |
| ***D05C 7/04*** | (2006.01) |
| ***D05C 7/08*** | (2006.01) |

(52) U.S. Cl.

CPC ..... *D05C 7/08* (2013.01); *D05D 2303/12* (2013.01); *D05D 2305/00* (2013.01)

(56) References Cited

U.S. PATENT DOCUMENTS

| | | | | |
|---|---|---|---|---|
| 5,195,451 | A * | 3/1993 | Nakashima | D05B 21/00 112/102.5 |
| 5,553,559 | A * | 9/1996 | Inoue | D05B 19/08 112/102.5 |
| 5,855,176 | A * | 1/1999 | Takenoya | D05B 19/08 112/102.5 |
| 6,167,822 | B1 * | 1/2001 | Miyasako | D05B 19/006 112/102.5 |
| 8,539,893 | B2 * | 9/2013 | Tokura | D05B 19/12 112/102.5 |
| 8,607,721 | B2 * | 12/2013 | Koga | D05B 19/12 112/475.05 |
| 2006/0096510 | A1 * | 5/2006 | Kuki | D05B 19/08 112/102.5 |
| 2009/0043417 | A1 * | 2/2009 | Yamada | D05B 19/12 700/138 |
| 2011/0056420 | A1 | 3/2011 | Kawaguchi et al. | |
| 2014/0182432 | A1 | 7/2014 | Muto | |
| 2014/0182463 | A1 | 7/2014 | Muto | |
| 2014/0188268 | A1 | 7/2014 | Tashiro | |
| 2016/0160414 | A1 * | 6/2016 | Oda | D05B 19/08 112/470.07 |

FOREIGN PATENT DOCUMENTS

| | | | |
|---|---|---|---|
| JP | H08-71287 | A | 3/1996 |
| JP | 2011-055887 | A | 3/2011 |
| JP | 2011-213079 | A | 10/2011 |
| JP | 2013-104146 | A | 5/2013 |
| JP | 2014-124747 | A | 7/2014 |
| JP | 2014-124748 | A | 7/2014 |
| JP | 2014-125711 | A | 7/2014 |
| JP | 2014-136037 | A | 7/2014 |

OTHER PUBLICATIONS

International Preliminary Report on Patentability issued in the corresponding International Application No. PCT/JP2016/051661 dated Aug. 8, 2017.

* cited by examiner

SEWING MACHINE

CROSS-REFERENCE TO RELATED APPLICATION

This application is a continuation application of International Application No. PCT/JP2016/051661, filed Jan. 21, 2016, which claims priority from Japanese Patent Application No. 2015-020795, filed on Feb. 5, 2015. The disclosure of the foregoing application is hereby incorporated by reference in its entirety.

BACKGROUND

The present disclosure relates to a sewing machine that sews a pattern on a sewing object.

A cutting device is known that creates a sheet material on which decorative components, such as rhinestones or the like, are arranged. The cutting device cuts the sheet material in accordance with cutting data, and can form a plurality of holes in which the rhinestones are arranged. The rhinestones arranged in each of the holes of the sheet material are adhered to a transfer sheet and removed from the sheet material, and are arranged on a cloth or the like while maintaining their mutual positional relationships. A hot melt layer is provided on a rear surface of each of the rhinestones and the rhinestones are bonded and fixed to the cloth using an iron or the like.

SUMMARY

When rhinestones are fixed onto a cloth on which a pattern, such as embroidery, has been sewn, there is a case in which it is difficult to determine overall positioning while aligning positions of each of the plurality of rhinestones adhered to the transfer sheet with the pattern.

Various embodiments of the broad principles derived herein provide a sewing machine that is capable of easily determining positions of a pattern sewn on a sewing object and of decorative components arranged on the sewing object.

Embodiments provide a sewing machine that includes a sewing portion, a processor, and a memory. The sewing portion is configured to sew a pattern on a sewing object. The memory storing computer-readable instructions that, when executed by the processor, perform the processes. The processes include acquiring reference data representing a relative positional relationship between a sewing position and an arrangement position. The sewing position is a position of the pattern sewn on the sewing object by the sewing portion. The arrangement position is a position of a decorative component arranged on the sewing object. The processes include the displaying, on the basis of the acquired reference data, a mark that indicates the arrangement position corresponding to the sewing position.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. The present embodiment is an example of a case in which the present disclosure is applied to a sewing machine that sews a pattern on a sewing object (a processing cloth, for example). The pattern according to the present embodiment refers to an embroidery pattern sewn on the basis of embroidery data. The embroidery pattern is, for example, a pattern of characters and graphics etc. formed using embroidery.

First, a physical configuration of a sewing machine 1 will be explained with reference to FIG. 1 to FIG. 3. In the following explanation, the upper side, the lower side, the lower left side, the upper right side, the lower right side and the upper left side in FIG. 1 respectively define an upper side, a lower side, a left side, a right side, a front side and a rear side of the sewing machine 1. Specifically, a surface on which a liquid crystal display (hereinafter referred to as an "LCD") 31 to be described later is arranged is the front surface of the sewing machine 1. A lengthwise direction of a bed portion 2 and an arm portion 4 is the left-right direction of the sewing machine 1, and a side on which a pillar portion 3 is provided is the right side. An elongation direction of the pillar portion 3 is the up-down direction of the sewing machine 1.

Figure 1:
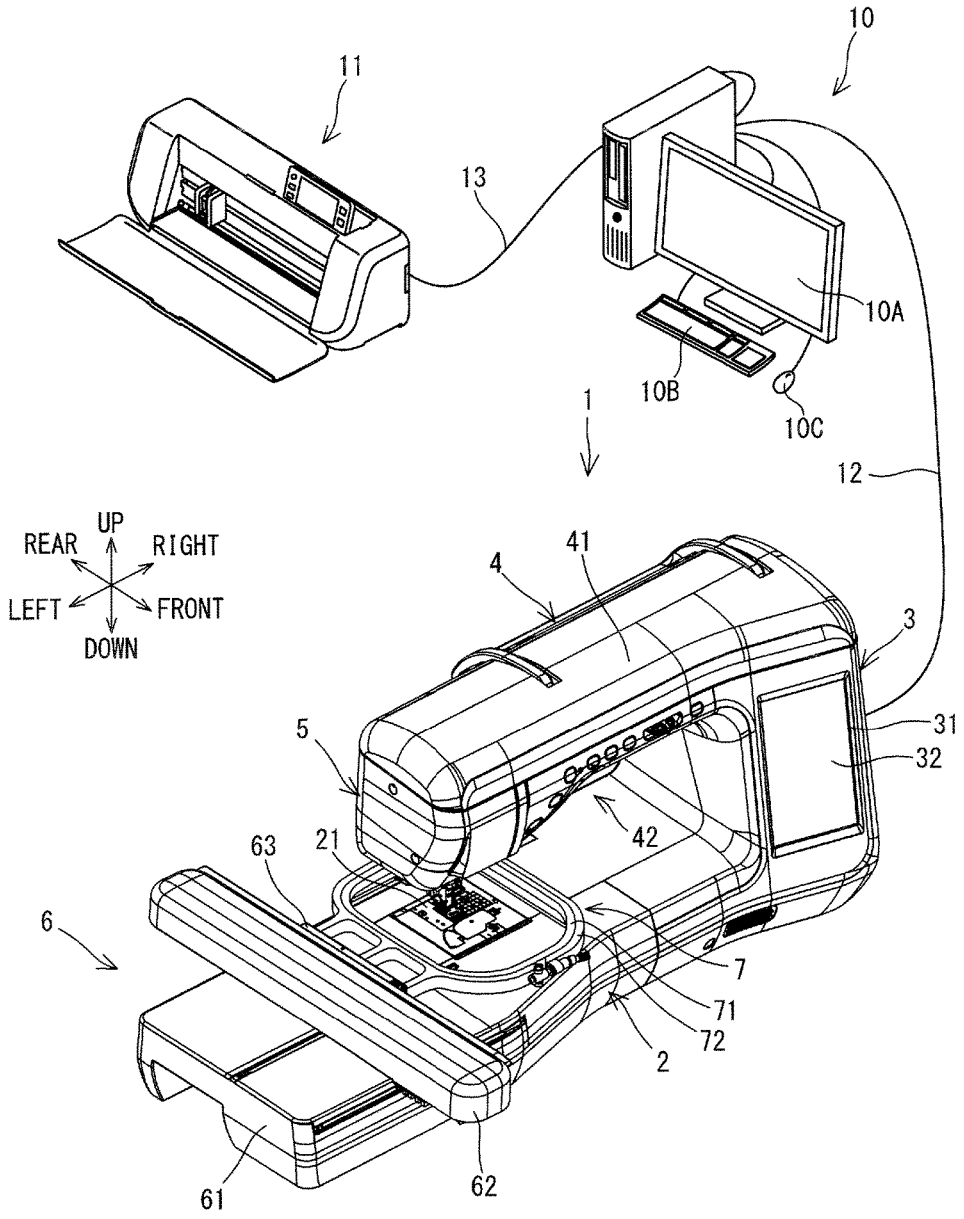
FIG. 1 is a perspective view of a sewing machine in a state in which an embroidery frame has been transported to a home position.

As shown in FIG. 1, the sewing machine 1 is provided with the bed portion 2, the pillar portion 3, the arm portion 4 and a head portion 5. The bed portion 2 is a base of the sewing machine 1 that extends in the left-right direction. The pillar portion 3 is provided standing upward on the right end portion of the bed portion 2. The arm portion 4 extends to the left from the upper portion of the pillar portion 3 and faces the bed portion 2. The head portion 5 is a portion connected to the left leading end portion of the arm portion 4.

Figure 2:
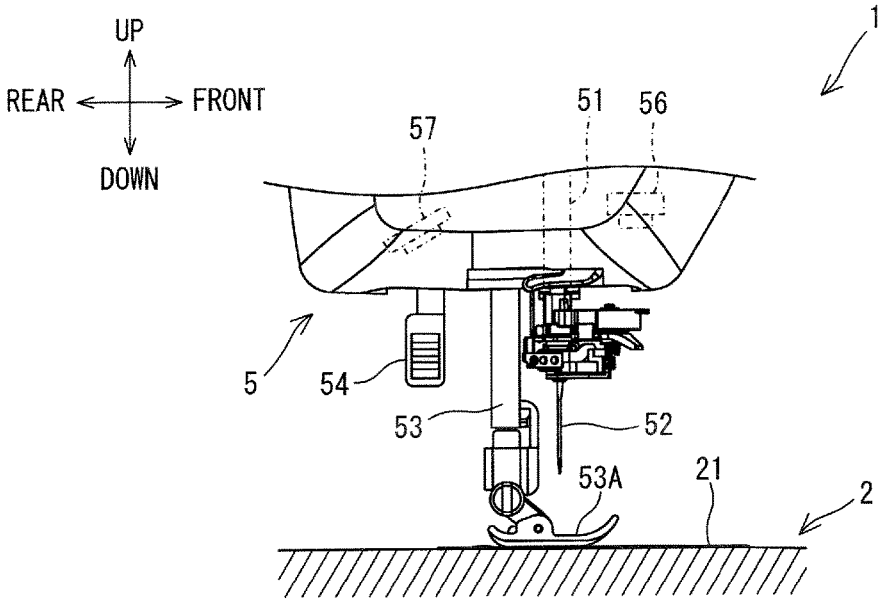
FIG. 2 is a left side view of the sewing machine showing a configuration of the vicinity of a head portion.

As shown in FIG. 1 and FIG. 2, a rectangular needle plate 21 is provided in the top surface of the bed portion 2. The top surface of the needle plate 21 forms substantially the same plane as the top surface of the bed portion 2. During sewing, a processing cloth 73 (refer to FIG. 3), which is clamped by an embroidery frame 7, is placed on the top surfaces of the bed portion 2 and the needle plate 21. The needle plate 21 is installed below a needle bar 51 provided on the head portion 5. A needle hole (not shown in the drawings), which penetrates the needle plate 21 in the thickness direction, is formed in the needle plate 21. The needle hole is an elliptical hole that extends in the left-right direction. During the sewing, a needle tip of a sewing needle 52 mounted on the bottom end of the needle bar 51 is inserted through the needle hole in accordance with the up-and-down movement of the needle bar 51.

A lower shaft (not shown in the drawings) is provided inside the bed portion 2. The lower shaft is driven to rotate by a drive shaft (not shown in the drawings) that will be described later. In the inside of the bed portion 2 below the needle plate 21, a feed mechanism (not shown in the drawings), a shuttle mechanism 22 (refer to FIG. 4) and the like are provided. The feed mechanism is a mechanism that drives a feed dog (not shown in the drawings). In a state in which a transport mechanism 6 (to be described later) is not mounted on the sewing machine 1, the feed dog transports the processing cloth 73 when sewing of a practical-use pattern or a decorative pattern is performed. The practical-use pattern is a pattern formed by stitches for practical use, such as straight lines, zig-zags, overcasting stitches etc. The decorative pattern is a pattern formed by continuously sewing a plurality of individual patterns, the individual patterns being a geometric pattern (such as a triangle), a schematic pattern (such as a floral pattern), or the like. The shuttle mechanism 22 is a mechanism having a known configuration that moves in concert with the sewing needle 52, and forms stitches in the processing cloth 73.

As shown in FIG. 1, the LCD 31 is provided in the front surface of the pillar portion 3. The LCD 31 has a rectangular shape that extends in the up-down direction in a front view. The LCD 31 displays screens that include various items, such as commands, illustrations, setting values, messages and the like. A touch panel 32 is provided on the front surface side of the LCD 31. The touch panel 32 receives input of operations using a finger or a dedicated touch pen and the like. A sewing machine motor 33 (refer to FIG. 4), and a control portion 8 (refer to FIG. 4) etc. are provided inside the pillar portion 3. The sewing machine motor 33 drives and rotates the drive shaft (not shown in the drawings) provided inside the arm portion 4. The drive shaft and the lower shaft are connected by a timing belt (not shown in the drawings). The rotation of the drive shaft is transmitted to the lower shaft. The drive shaft and the lower shaft rotate in synchronization with each other. A USB connector (not shown in the drawings) is provided on the right side surface of the pillar portion 3.

The sewing machine 1 can be connected to a known personal computer (hereinafter referred to as a "PC") 10, via a USB cable 12 that is connected to the USB connector. In marking processing that will be described later, the sewing machine 1 sews the embroidery pattern on the processing cloth 73 on the basis of embroidery data received from the PC 10, and displays a mark 60 (refer to FIG. 8) on the processing cloth 73 on which the embroidery pattern has been sewn, on the basis of reference data. Note that, in the present embodiment, the PC 10 is connected to a cutting device 11, via a USB cable 13. The cutting device 11 can cut paper or cloth in a desired shape. The cutting device 11 is a device of a known configuration. In the present embodiment, on the basis of formation data received from the PC 10, the cutting device 11 forms a plurality of hole portions 19 in a holding body 18, in order to hold decorative components 16 (refer to FIG. 6).

An openable/closable cover 41 is provided on the upper portion of the arm portion 4. Note that in FIG. 1, the cover 41 is in a closed state. A thread spool (not shown in the drawings) is housed below the cover 41. During the sewing, an upper thread (not shown in the drawings) that is wound on the thread spool is supplied from the thread spool to the sewing needle 52 mounted on the needle bar 51, via a predetermined path provided in the head portion 5. A plurality of operating switches 42, including a sewing start/stop switch and the like, are provided on a lower portion of the front surface of the arm portion 4.

As shown in FIG. 2, the needle bar 51, a presser bar 53, an up-and-down movement motor 50 (refer to FIG. 4), a needle bar up-and-down movement mechanism 55 (refer to FIG. 4), an up-down lever 54, an image sensor 56, an irradiation mechanism 57 and the like are provided on the head portion 5. The needle bar 51 and the presser bar 53 extend downward from the lower end portion of the head portion 5. The sewing needle 52 can be mounted on the lower end of the needle bar 51. The presser bar 53 moves up and down in accordance with operation of the up-down lever 54 or driving of the up-and-down movement motor 50. A presser foot 53A is mounted on the lower end portion of the presser bar 53. The presser foot 53A can be removed from the presser bar 53. The needle bar up-and-down movement mechanism 55 is a mechanism that moves the needle bar 51 up and down in accordance with the rotation of the drive shaft.

The image sensor 56 is, for example, a known complementary metal oxide semiconductor (CMOS) image sensor. The image sensor 56 is fixed to a machine casing (not shown in the drawings) of the sewing machine 1 on the lower portion of the head portion 5. The image sensor 56 captures an image of a predetermined range, and outputs corresponding image data. The output image data is stored in a predetermined storage area of a RAM 83 (refer to FIG. 4) of the control portion 8. A wide angle lens (not shown in the drawings) is attached to the image sensor 56. When the embroidery frame 7 (to be described later) has been transported to the home position illustrated in FIG. 1, and when the embroidery frame 7 has been transported to a retracted position illustrated in FIG. 3, the image sensor 56 can capture an image of the inside of an inner frame 71 of the embroidery frame 7.

Note that, in the present embodiment, a coordinate system of a captured image represented by the image data created by the image sensor 56 is associated, in advance, with an entire space coordinate system (hereinafter also referred to as a "world coordinate system"), using parameters stored in a flash memory 84. Further, a unique XY coordinate system (an embroidery coordinate system) over which the embroidery frame 7 is transported by the transport mechanism 6 (to be described later) is also associated in advance with the world coordinate system, using the parameters stored in the flash memory 84. Thus, on the basis of the image data, the sewing machine 1 can perform processing that indicates coordinates of the embroidery coordinate system. As a result, the sewing machine 1 can indicate a position of the embroidery pattern to be sewn on the processing cloth 73, from the captured image.

Figure 8:
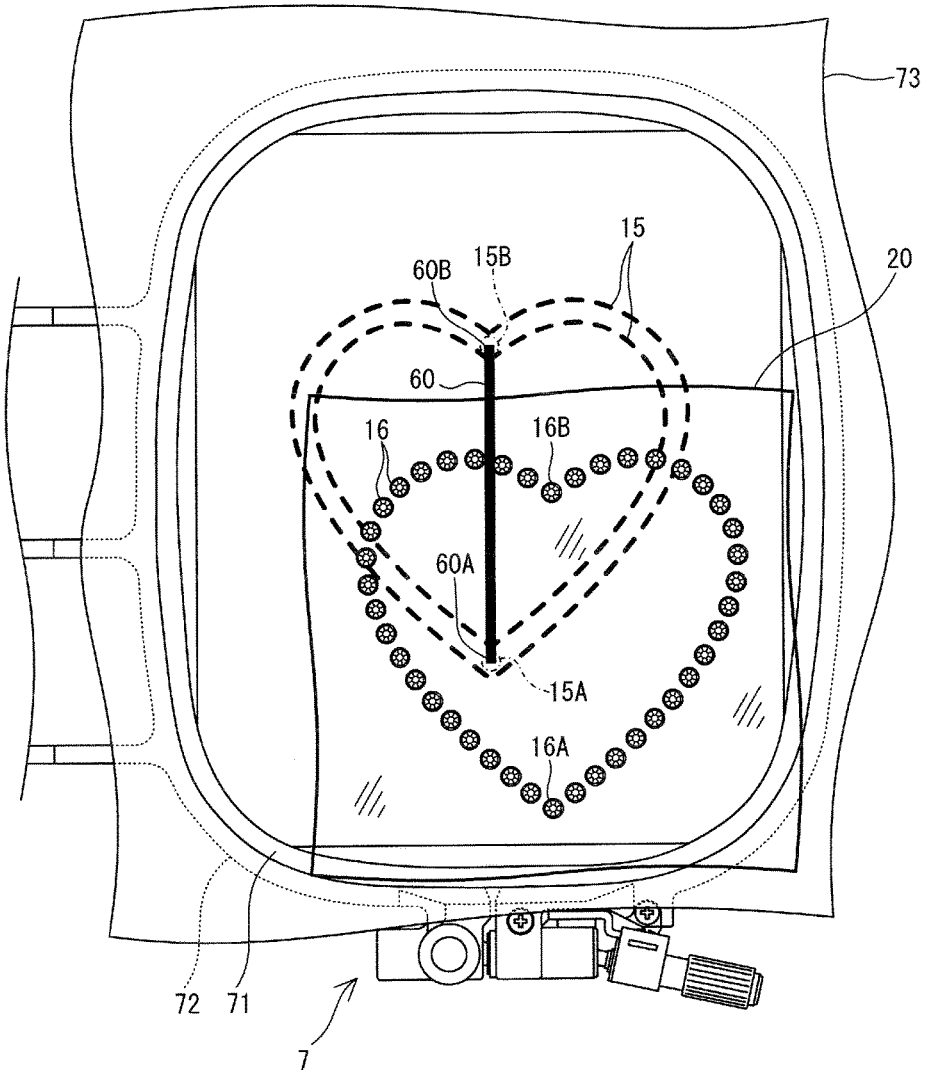
FIG. 8 is a diagram showing a manner in which, when the embroidery frame has been transported to the retracted position, a sewing position of an embroidery pattern and arrangement positions of decorative components are aligned.

The irradiation mechanism 57 displays the light mark (hereinafter referred to as the "mark") 60 (refer to FIG. 8). When the decorative components 16 (to be described later) are arranged on the processing cloth 73, the mark 60 is used as a reference in aligning the positions of an embroidery pattern 15 and the decorative components 16. The irradiation mechanism 57 is fixed to the machine casing (not shown in the drawings) of the sewing machine 1, on the lower portion of the head portion 5. The irradiation mechanism 57 is provided with a movement motor 58 and a laser emitter 59. The laser emitter 59 emits red light toward a reflecting mirror (not shown in the drawings). The movement motor 58 is a pulse motor, and drives a gear mechanism (not shown in the drawings), thus changing an emission direction of the red light emitted by the laser emitter 59. The red light emitted by the laser emitter 59 is reflected by the reflecting mirror, and enters into a lenticular lens (not shown in the drawings). The red light that has entered the lenticular lens is refracted, is spread in the front-rear direction, and is emitted toward a position below the lenticular lens. Note that, in the irradiation mechanism 57 of the present embodiment, the lenticular lens is further provided with a filter, an aperture of the filter can be adjusted by the driving of the gear mechanism, and the length of the red light in the front-rear direction can thus be adjusted. The red light emitted from the lenticular lens is irradiated toward the top surface of the bed portion 2 positioned below the irradiation mechanism 57. When the embroidery frame 7 (to be described later) is transported to the retracted position illustrated in FIG. 3, the irradiation mechanism 57 displays the mark 60 on the processing cloth 73 clamped by the embroidery frame 7.

Note that, in the present embodiment, a coordinate system (an irradiation coordinate system) of an irradiation position of the red light irradiated by the irradiation mechanism 57 is associated, in advance, with the world coordinate system, using parameters stored in the flash memory 84. Thus, the sewing machine 1 can irradiate the red light in alignment with the position of the embroidery pattern that has been sewn on the processing cloth 73, and can display the mark 60 on the processing cloth 73. Further, in the state in which the transport mechanism 6 is not mounted on the sewing machine 1, the mark 60 can also be used as a reference for position alignment of the processing cloth 73 when the practical-use pattern or the decorative pattern is sewn.

Figure 3:
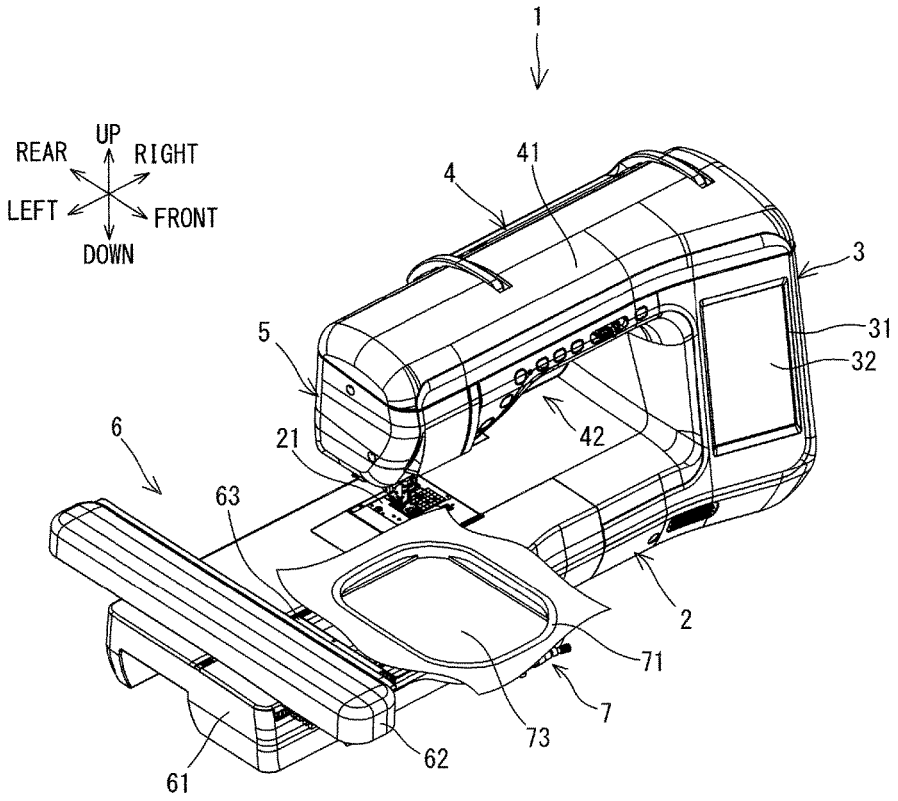
FIG. 3 is a perspective view of the sewing machine in a state in which the embroidery frame has been transported to a retracted position.

As shown in FIG. 1 and FIG. 3, the sewing machine 1 is provided with the embroidery frame transport mechanism (hereinafter referred to as the "transport mechanism") 6. The transport mechanism 6 can be mounted on and removed from the bed portion 2 of the sewing machine 1. FIG. 1 shows a state in which the transport mechanism 6 is mounted on the sewing machine 1. When the transport mechanism 6 is mounted on the sewing machine 1, the transport mechanism 6 and the sewing machine 1 are electrically connected. The transport mechanism 6 is provided with a main body portion 61 and a carriage 62. The carriage 62 is provided above the main body portion 61. The carriage 62 has a cuboid shape that is long in the front-rear direction. The carriage 62 is provided with a frame holder 63, a Y-axis transport mechanism (not shown in the drawings) and a Y-axis motor 64 (refer to FIG. 4). The frame holder 63 is provided on the right side surface of the carriage 62. A plurality of types of the embroidery frame 7 can be selectively mounted on and detached from the frame holder 63. The embroidery frame 7 is a frame body of a known configuration that clamps the processing cloth 73 (refer to FIG. 3) using the inner frame 71 and an outer frame 72. When the embroidery frame 7 has been transported to the home position illustrated in FIG. 1, the processing cloth 73 clamped by the embroidery frame 7 is arranged on the needle plate 21, and below the needle bar 51 and the presser bar 53. The home position is, for example, a position at which a center point inside the inner frame 71 of the embroidery frame 7 is arranged directly below the needle bar 51. The Y-axis transport mechanism transports the frame holder 63 in the front-rear direction (the Y-axis direction). When the frame holder 63 is transported in the front-rear direction, the embroidery frame 7 transports the processing cloth 73 in the front-rear direction. The Y-axis motor 64 drives the Y-axis transport mechanism.

An X-axis transport mechanism that is not shown in the drawings and an X-axis motor 65 (refer to FIG. 4) are provided inside the main body portion 61. The X-axis transport mechanism transports the carriage 62 in the left-right direction (the X-axis direction). When the carriage 62 is transported in the left-right direction, the embroidery frame 7 transports the processing cloth 73 in the left-right direction. The X-axis motor 65 drives the X-axis transport mechanism. The transport mechanism 6 can transport the embroidery frame 7 mounted on the carriage 62 to a position represented by the unique XY coordinate system (the embroidery coordinate system). The decorative components 16 (to be described later) are arranged on the processing cloth 73 when the embroidery frame 7 has been transported to the retracted position shown in FIG. 3. The retracted position is, for example, a position in which the embroidery frame 7 is not disposed directly below the needle bar 51, and within a range over which the irradiation mechanism 57 can irradiate the mark 60.

Figure 4:
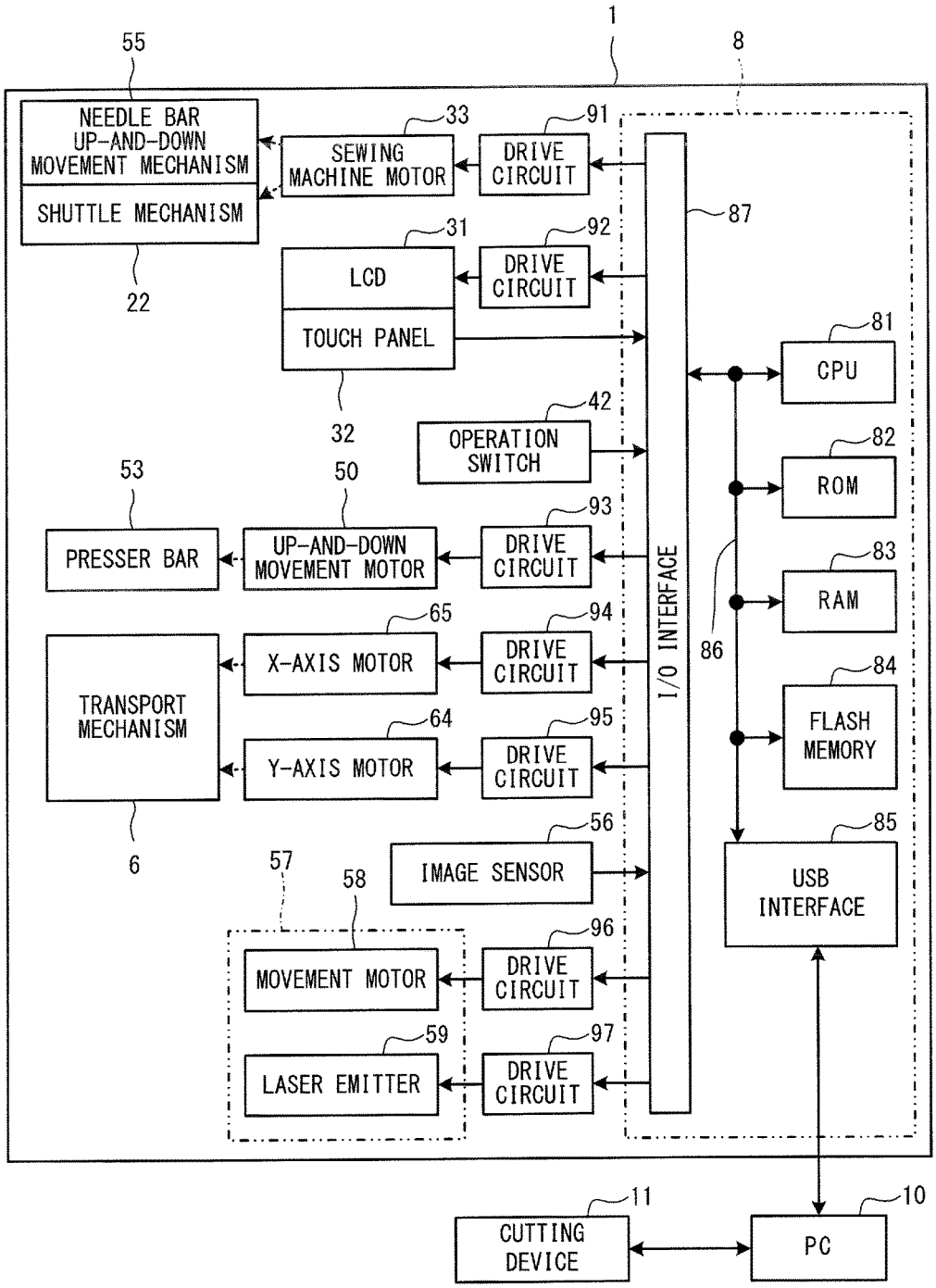
FIG. 4 is a block diagram showing an electrical configuration of the sewing machine.

An electrical configuration of the sewing machine 1 will be explained with reference to FIG. 4. The control portion 8 of the sewing machine 1 is provided with a CPU 81, a ROM 82, the RAM 83, the flash memory 84, a USB interface 85, and an input/output (I/O) interface 87. The ROM 82, the RAM 83, the flash memory 84, the USB interface 85 and the input/output (I/O) interface 87 are each connected to the CPU 81 by a bus 86.

The CPU 81 performs main control of the sewing machine 1 and executes various arithmetic calculations and processing related to sewing, in accordance with various programs stored in the ROM 82. Although not shown in the drawings, the ROM 82 is provided with a plurality of storage areas including a program storage area. The various programs used to operate the sewing machine 1 are stored in the program storage area. The stored programs include, for example, a program for the marking processing (to be described later) and the like. Storage areas are provided as necessary in the RAM 83 that store arithmetic calculation results resulting from arithmetic calculation processing by the CPU 81. The various parameters used to execute the various processing by the sewing machine 1 are stored in the flash memory 84. The parameters that associate the above-described embroidery coordinate system, irradiation coordinate system, and world coordinate system with each other are also stored in the flash memory 84. The USB interface 85 is an interface to connect the sewing machine 1 and the PC 10 via the USB cable 12. As described above, the PC 10 is connected to the cutting device 11 via the USB cable 13.

Drive circuits 91 to 97, an operation switch 42, the touch panel 32, and the image sensor 56 are connected to the I/O interface 87. The drive circuit 91 is connected to the sewing machine motor 33, and drives the sewing machine motor 33 in accordance with control signals from the CPU 81. The drive circuit 92 drives the LCD 31 in accordance with control signals from the CPU 81, and causes images, operation screens and the like to be displayed on the LCD 31. The touch panel 32 provided on the front surface side of the LCD 31 outputs, to the CPU 81, coordinate data representing an input position of an operation using a finger or a dedicated touch pen etc. On the basis of the coordinate data acquired from the touch panel 32, the CPU 81 recognizes an item selected on the operation screen displayed on the LCD 31, and executes corresponding processing. The operation switch 42 receives, separately from the touch panel 32, input of an operation on the sewing machine 1, and outputs the received input to the CPU 81. For example, when input of an operation on the start/stop switch is received, the CPU 81 outputs a control signal to start or stop a sewing operation.

The drive circuit 93 is connected to the up-and-down movement motor 50, and drives the up-and-down movement motor 50 in accordance with control signals from the CPU 81. The presser bar 53 moves up and down in accordance with the driving of the up-and-down movement motor 50. The drive circuit 94 is connected to the X-axis motor 65 and drives the X-axis motor 65 in accordance with control signals from the CPU 81. The drive circuit 95 is connected to the Y-axis motor 64, and drives the Y-axis motor 64 in accordance with control signals from the CPU 81. In accordance with the driving of the X-axis motor 65 and the Y-axis motor 64, the embroidery frame 7 is transported in the left-right direction (the X-axis direction) and the front-rear direction (the Y-axis direction) by a movement amount depending on the control signal. The image sensor 56 outputs the image data generated by the image capture of the image capture range. The drive circuit 96 is connected to the movement motor 58 and drives the movement motor 58 in accordance with control signals from the CPU 81. The drive circuit 97 is connected to the laser emitter 59 and causes the laser emitter 59 to emit the red light in accordance with control signals from the CPU 81. The emission direction of the red light from the laser emitter 59 is changed in accordance with the driving of the movement motor 58.

The operations of the sewing machine 1 will be briefly explained. During the embroidery sewing, the CPU 81 of the sewing machine 1 controls the driving of the sewing machine motor 33, and the driving of the X-axis motor 65 and the Y-axis motor 64 of the transport mechanism 6, on the basis of the embroidery data acquired from the PC 10. The needle bar up-and-down movement mechanism 55 and the shuttle mechanism 22 are driven at the same time that the embroidery frame 7 is transported in the left-right direction (the X-axis direction) and the front-rear direction (the Y-axis direction) by the transport mechanism 6. In this way, the embroidery pattern is sewn on the processing cloth 73 clamped by the embroidery frame 7 by the sewing needle 52 mounted on the needle bar 51. Meanwhile, when the normal practical-use pattern or decorative pattern that is not the embroidery pattern is to be sewn, the transport mechanism 6 is removed from the bed portion 2. The CPU 81 of the sewing machine 1 controls the driving of the sewing machine motor 33 on the basis of input of an operation received by the operation switch 42 or the like. The needle bar up-and-down movement mechanism 55 and the shuttle mechanism 22 are driven at the same time that the processing cloth 73 placed on the bed portion 2 is transported by the feed mechanism. In this way, the practical-use pattern or the decorative pattern is sewn on the processing cloth 73 on top of the bed portion 2, by the sewing needle 52 mounted on the needle bar 51. Note that the practical-use pattern or the decorative pattern may be sewn on the processing cloth 73 on the basis of embroidery data received from the PC 10 or embroidery data stored in advance in the flash memory 84, by driving a needle bar swinging mechanism (not shown in the drawings) of a known configuration.

Figure 5:
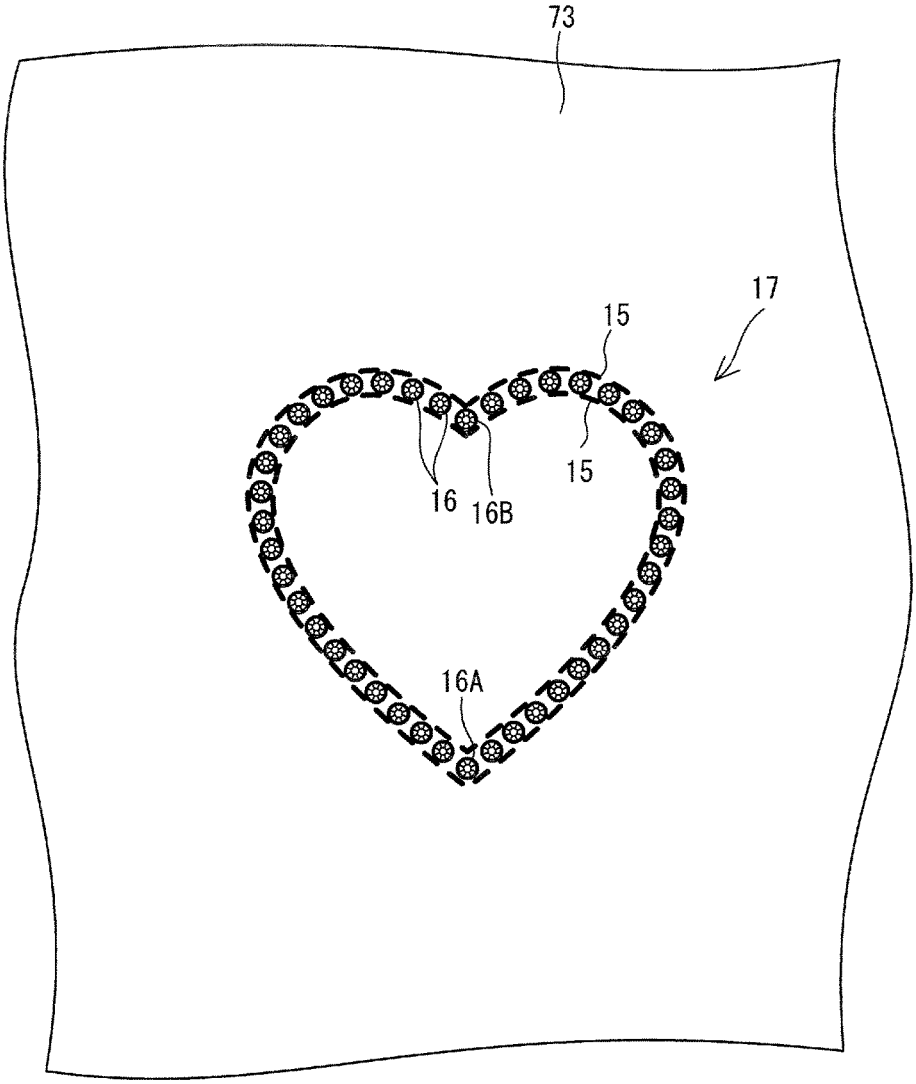
FIG. 5 is a diagram showing a state in which a decorated pattern is formed on a processing cloth.

In the present embodiment, as shown in FIG. 5, after the embroidery pattern 15 has been embroidered on the processing cloth 73 by the sewing machine 1, a decorated pattern 17 is created by combining the decorative components 16 and the embroidery pattern 15. When the decorative components 16 are arranged, the sewing machine 1 can display the mark 60 as a marker on the processing cloth 73. The embroidery data used to sew the embroidery pattern 15 is, for example, created by executing a predetermined application on the PC 10. A CPU (not shown in the drawings) of the PC 10 edits the shape of the embroidery pattern 15 in accordance with operation of the application by a user, and creates the embroidery data for forming the embroidery pattern 15 on the basis of results of the editing. The embroidery data is, for example, data that takes the position of the center point of the inside of the inner frame 71 of the embroidery frame 7 as the home position of the embroidery coordinate system, and indicates positions of needle drop points, in a sewing order, using relative movement amounts of the embroidery frame 7 in the X-axis direction and the Y-axis direction.

In creating the decorated pattern 17, the plurality of decorative components 16 are aligned in advance in an arrangement relationship that accords with the embroidery pattern 15, using the holding body 18 machined by the cutting device 11. The plurality of decorative components 16 are arranged on the processing cloth 73 on which the embroidery pattern 15 has been formed, in a state in which the mutual positional relationships of the decorative components 16 are maintained. The decorative components 16 of the present embodiment are, for example, rhinestones. The mutual positions of the plurality of rhinestones are determined by the rhinestones being respectively held in the plurality of hole portions 19 (refer to FIG. 6) formed in the holding body 18. The formation data used for the cutting device 11 to form the hole portions 19 in the holding body 18 is created, for example, by executing a predetermined application on the PC 10. The CPU of the PC 10 determines the mutual positional relationships of the decorative components 16 in accordance with operation of the application by the user. Further, the CPU of the PC 10 creates the formation data used to form the hole portions 19 in the holding body 18, on the basis of the mutual positional relationships of the decorative components 16. For example, a position of an upper left corner of the holding body 18 is a home position in the unique XY coordinate system (a formation coordinate system) to which the holding body 18 is transported. At that time, the formation data is, for example, data that represents a center position and a diameter of each of the hole portions 19, in a formation order, using relative movement amounts of the holding body 18 in the X-axis direction and the Y-axis direction. Specifically, the formation data is data representing formation positions of the hole portions 19 formed in the holding body 18. The formation data includes first formation data and second formation data. The first formation data is data representing the formation positions of the hole portions 19 in order to indicate arrangement positions of the decorative components 16 corresponding to a sewing position of the embroidery pattern 15. The second formation data is data representing the formation positions of the hole portions 19 in order to indicate arrangement positions of characteristic decorative components 16A and 16B (to be described later), which are used in the reference data in order to determine the arrangement positions of the decorative components 16.

In addition, in the creation of the decorated pattern 17, each of the plurality of decorative components 16 is arranged on the processing cloth 73 in alignment with the mark 60 displayed on the processing cloth 73, in the state in which the mutual positional relationships between the decorative components 16 are maintained. As a result, each of the plurality of decorative components 16 is arranged in the arrangement positions corresponding to a sewing position of the embroidery pattern 15. When the user arranges the decorative components 16 while aligning their positions with the embroidery pattern 15, the sewing machine 1 displays the mark 60 on the processing cloth 73 to act as a position aligning reference, on the basis of the reference data. For example, the CPU of the PC 10 executes the predetermined application and creates the reference data on the basis of the embroidery data and the formation data. The CPU of the PC 10 associates the formation data with the embroidery data, and identifies the coordinate data of the embroidery coordinate system from the coordinate data, of the formation coordinate system, of the arrangement positions of the decorative components 16. The formation data includes the first formation data and the second formation data. The reference data includes, on the basis of the first formation data, the coordinate data of the embroidery coordinate system representing the arrangement position of each of the decorative components 16. The reference data further includes, on the basis of the second formation data, the coordinate data representing the characteristic arrangement positions of the decorative components 16, namely, the arrangement positions of the decorative components 16A and 16B. The characteristic arrangement positions of the decorative components 16 are positions having characteristics that allow easy identification of those decorative components 16 from among the plurality of decorative components 16. For example, the characteristic arrangement position may be the arrangement position of the decorative component 16 positioned at the end of a group of the decorative components 16, or may be the arrangement position of the decorative component 16 that is detached from the group of the decorative components 16. Alternatively, the characteristic arrangement position may be the arrangement position of the decorative component 16 positioned on a change point at which, on a straight line or a curved line that virtually joins the adjacent decorative components 16, a direction along which the decorative components 16 follow that straight line or curved line suddenly changes. In the decorated pattern 17 shown in FIG. 5, for example, the plurality of decorative components 16 are arranged in alignment with the embroidery pattern 15 that shows a heart shape. In this case, among the plurality of decorative components 16, the arrangement position of the decorative component 16A and the arrangement position of the decorative component 16B may be recognized as the characteristic arrangement positions. The arrangement position of the decorative component 16A is a characteristic arrangement position positioned at the lower end in the center in the left-right direction. The arrangement position of the decorative component 16B is a characteristic arrangement position positioned in an upper portion in the center in the left-right direction. In this way, using the reference data, the relative positional relationships of the sewing position of the embroidery pattern 15 represented by the embroidery data and the arrangement positions of the decorative components 16 are associated with each other. Thus, using the reference data, the relative positional relationships of the sewing position and the formation positions of the hole positions 19 formed in the holding body 18 using the formation data are associated with each other.

Figure 6:
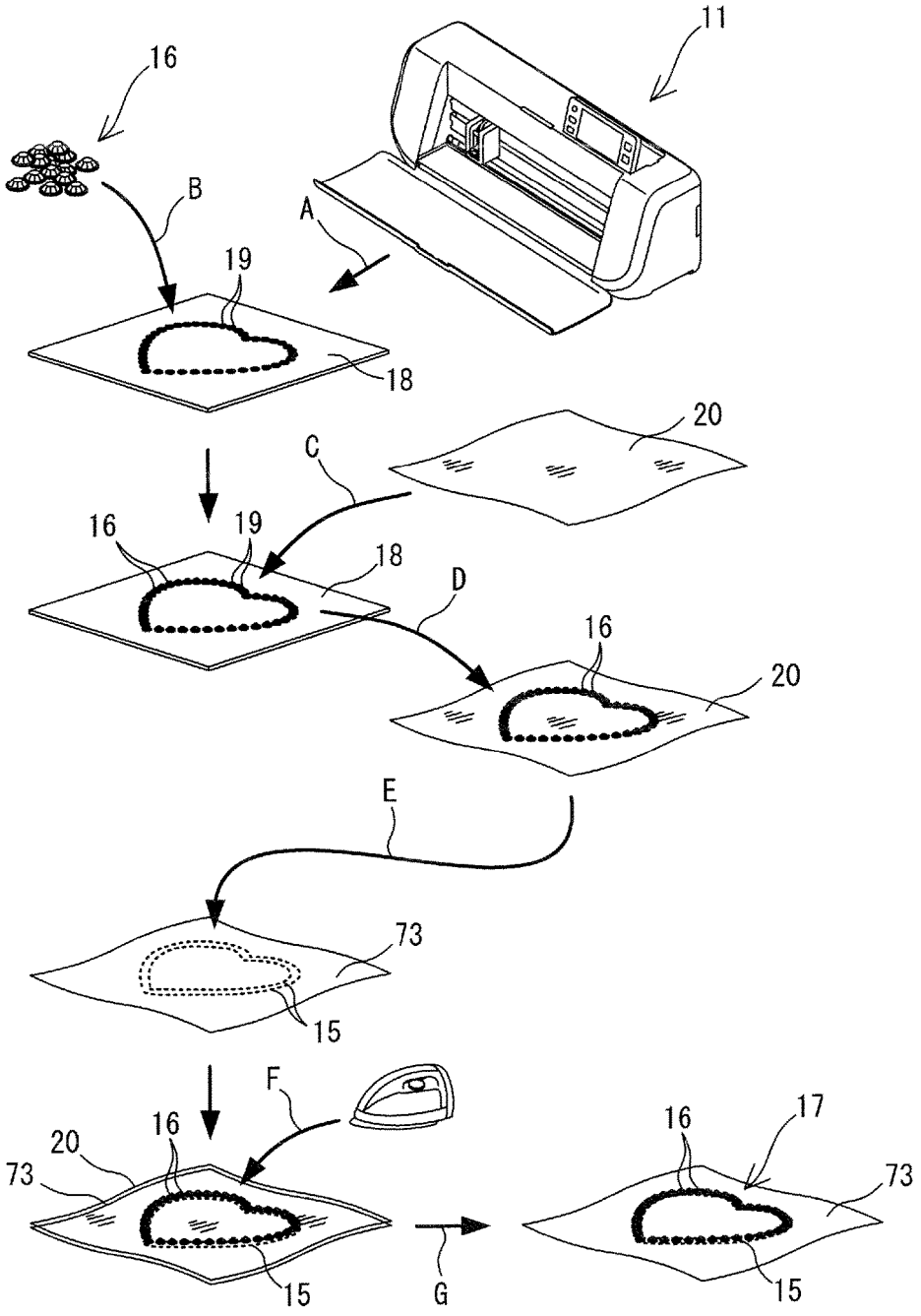
FIG. 6 is a flow diagram showing a process of forming the decorated pattern on the processing cloth.

As shown in FIG. 6, the decorative components 16 are combined with the embroidery pattern 15 and form the decorated pattern 17 as a result of processes described below. On the basis of the formation data created in the PC 10, the cutting device 11 forms the plurality of hole portions 19 in the holding body 18 (a process A). Note that the hole portions 19 may be through holes that penetrate the holding body 18, or may be recessed portions that do not penetrate the holding body 18. The plurality of decorative components 16 are arranged on the holding body 18 in which the hole portions 19 are formed, and are spread over the top of the holding body 18 by being swept by a brush or the like. The individual decorative components 16 fit into the hole portions 19, and are respectively held inside the hole portions 19 (a process B). The decorative component 16 has a cone shape in the up-down direction. When the decorative components 16 are swept by the brush on top of the holding body 18, only the decorative components 16 arranged with the cone oriented upward are held inside the hole portions 19, and the decorative components 16 that have a different orientation are ejected from the hole portions 19.

In a state in which the decorative components 16 are arranged in all of the hole portions 19, and the mutual positions between the decorative components 16 have been determined, a transfer sheet 20 is arranged on the holding body 18 (a process C). An adhesive is applied to the bottom surface of the transfer sheet 20. When the transfer sheet 20 is peeled off from the holding body 18, the transfer sheet 20 separates from the holding body 18 in a state in which the decorative components 16 are adhered to the bottom surface of the transfer sheet 20 (a process D). The transfer sheet 20 is arranged on the processing cloth 73 on which the embroidery pattern 15 has been created by the sewing machine 1 on the basis of the embroidery data (a process E). The arrangement positions on the processing cloth 73 of the decorative components 16 held by being adhered to the transfer sheet 20, and the position alignment with the sewing position of the embroidery pattern 15 sewn on the processing cloth 73 will be described later. Heat treatment using an iron or the like is carried out on the processing cloth 73 on which the transfer sheet 20 has been arranged (a process F). An adhesive having thermoplasticity is applied to the bottom surface of each of the decorative components 16. The bottom surface of the decorative component 16 sticks firmly to the surface of the processing cloth 73 due to the adhesive. The transfer sheet 20 is removed from the processing cloth 73 (a process G). The user can obtain the processing cloth 73 on which the decorated pattern 17 is formed by combining the embroidery pattern 15 and the decorative components 16.

In the above-described manner, in the process E in which the transfer sheet 20 is arranged on the processing cloth 73, it is necessary for the user to align the sewing position of the embroidery pattern 15 with the arrangement positions of the decorative components 16. The sewing machine 1 of the present embodiment performs the marking processing in which the mark 60 is displayed to indicate the arrangement positions corresponding to the sewing position after the embroidery pattern 15 has been sewn. In this way, the sewing machine 1 can indicate, using the mark 60, the characteristic arrangement positions of the decorative components 16. The user can determine the positions of the decorative components 16 to be arranged in the characteristic arrangement positions on the basis of the mark 60, and can arrange the decorative components 16 on the processing cloth 73. As a result, the user can easily align the positions of the embroidery pattern 15 and all of the decorative components 16.

Hereinafter, the marking processing will be explained with reference to FIG. 7. When the user switches on the power to the sewing machine 1, the CPU 81 of the sewing machine 1 executes various programs, including the marking processing, stored in the ROM 82. The marking processing of the present embodiment is processing that performs the sewing of the embroidery pattern 15 and the display of the mark 60, on the basis of the embroidery data and the reference data transmitted from the PC 10. During the marking processing, the CPU 81 executes others of the programs in parallel, and stands by to receive the embroidery data and the reference data.

The CPU of the PC 10 creates the embroidery data, the formation data, and the reference data on the basis of operations by the user. The CPU of the PC 10 transmits the formation data to the cutting device 11. When the cutting device 11 has received the formation data, the cutting device 11 forms the plurality of hole portions 19 in the holding body 18, as described above, in order to determine the mutual positions between the plurality of decorative components 16. Further, the CPU of the PC 10 transmits the embroidery data and the reference data to the sewing machine 1. Note that, when the embroidery pattern 15 is created on the processing cloth 73 but the decorated pattern 17 is not to be created, the reference data is not created, and the CPU of the PC 10 transmits the embroidery data to the sewing machine 1.

When the CPU 81 of the sewing machine 1 receives the embroidery data, or the embroidery data and the reference data from the PC 10, the CPU 81 stores the data in the RAM 83 (step S1). The CPU 81 displays, on the LCD 31, a command to mount the embroidery frame 7 clamping the processing cloth 73 onto the frame holder 63 of the carriage 62. When the user has mounted the embroidery frame 7 onto the frame holder 63 in accordance with the message displayed on the LCD 31, the user operates the touch panel 32 and performs an input notifying the start of sewing. The CPU 81 drives the X-axis motor 65 and the Y-axis motor 64, and uses the transport mechanism 6 to transport the embroidery frame 7 to the home position (refer to FIG. 1) (step S3).

The CPU 81 drives the up-and-down movement motor 50, lowers the presser bar 53, and causes the presser foot 53A to come into contact with the processing cloth 73 (step S5). While transporting the embroidery frame 7 in accordance with the embroidery data, the CPU 81 drives the sewing machine motor 33 and thus drives the needle bar up-and-down movement mechanism 55 and the shuttle mechanism 22. The embroidery pattern 15 is sewn on the processing cloth 73 clamped by the embroidery frame 7 (step S7).

When the sewing processing on the basis of the embroidery data is complete, the CPU 81 determines whether or not the reference data associated with the embroidery data used in the sewing processing is stored in the RAM 83 (step S9). When the embroidery data created in the PC 10 is not used to form the decorated pattern 17 and the reference data is not stored in the RAM 83 (no at step S9), the CPU 81 ends the marking processing. The user operates the up-down lever 54 and raises the presser bar 53, thus separating the presser foot 53A from the processing cloth 73. The user removes the embroidery frame 7 from the transport mechanism 6, and removes the processing cloth 73 from the embroidery frame 7, thus obtaining the processing cloth 73 on which the embroidery pattern 15 is formed.

When the reference data is stored in the RAM 83 (yes at step S9), the CPU 81 drives the up-and-down movement motor 50, raises the presser bar 53, and separates the presser foot 53A from the processing cloth 73 (step S11). The CPU 81 drives the X-axis motor 65 and the Y-axis motor 64, and causes the embroidery frame 7 to be transported to the retracted position (refer to FIG. 3) (step S13).

While driving the laser emitter 59 and causing the red light to be emitted, the CPU 81 drives the movement motor 58 in accordance with the reference data and adjusts the emission direction and the length in the front-rear direction of the red light. As described above, the reference data represents the coordinate data of the decorative components 16A and 16B, which have the characteristic arrangement positions. As shown in FIG. 8, the red light is irradiated onto the processing cloth 73 clamped by the embroidery frame 7 that has been transported to the retracted position, and the mark 60 is displayed (step S15). An end portion 60A on the front side of the mark 60 in the front-rear direction is displayed at an arrangement position 15A of the decorative component 16A, and an end portion 60B on the rear side of the mark 60 in the front-rear direction is displayed at an arrangement position 15B of the decorative component 16B. As described above, the embroidery coordinate system that represents the coordinates of the sewing position of the embroidery pattern 15, and the coordinates of the arrangement positions of the decorative components 16A and 16B, is associated with the world coordinate system. In addition, the irradiation coordinate system that represents the coordinates of the irradiation position of the red light forming the mark 60 is also associated with the world coordinate system. Thus, the CPU 81 can indicate the arrangement positions of the decorative components 16A and 16B by using the positions to be displayed by the end portions 60A and 60B at both sides of the mark 60 in the front-rear direction.

Figure 7:
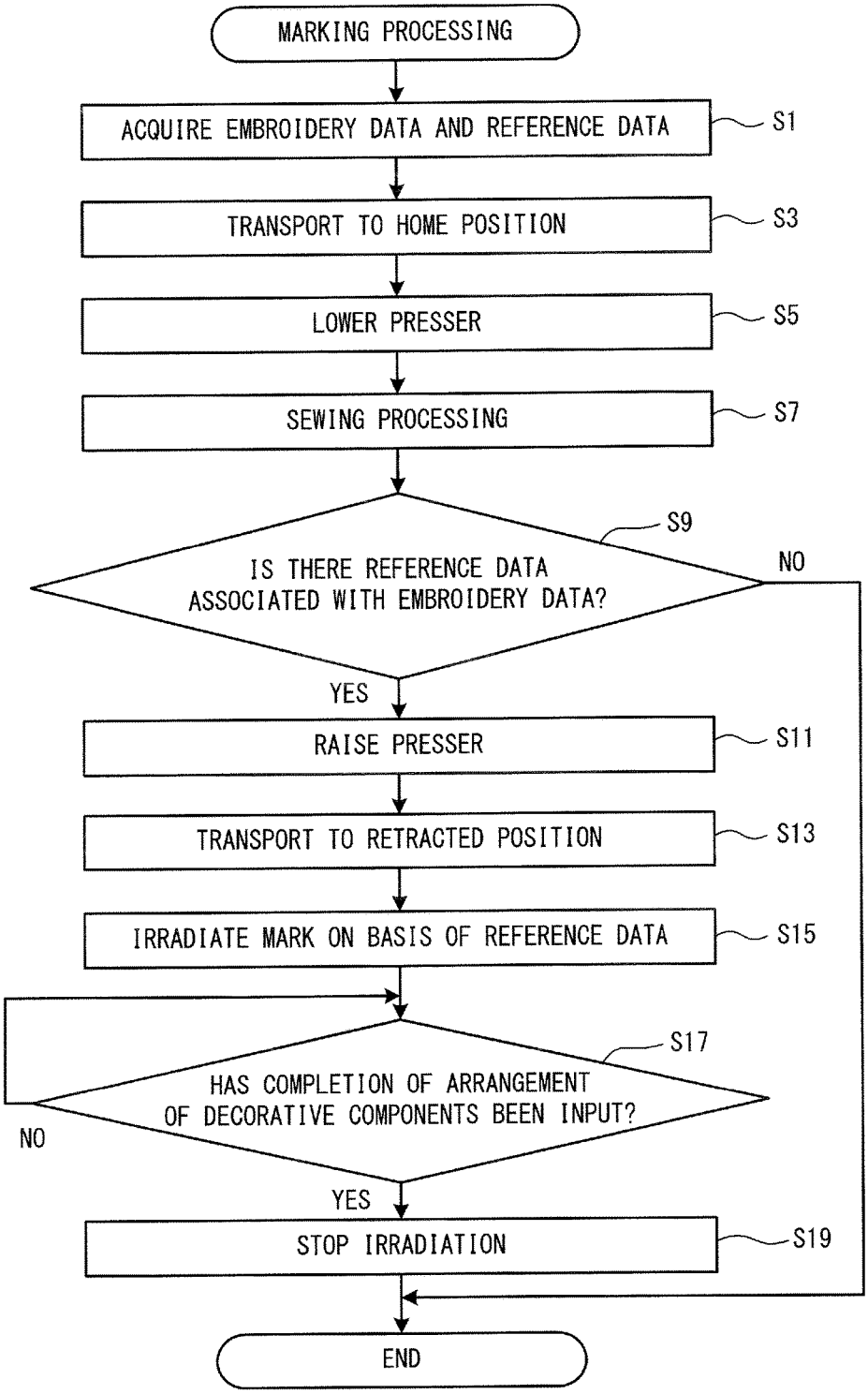
FIG. 7 is a flow chart of marking processing.

As shown in FIG. 7, the CPU 81 displays an image on the LCD 31 to receive input of an operation notifying completion of the arrangement of the decorative components 16, and stands by for the input (no at step S17). The user conveys the transfer sheet 20, to the bottom surface of which the plurality of decorative components 16 have been adhered in the above-described process D, onto the processing cloth 73 clamped by the embroidery frame 7. The user arranges the decorative components 16A and 16B by aligning the decorative components 16A and 16B with the positions displayed by the end portions 60A and 60B at both sides of the mark 60. The decorative components 16A and 16B are arranged at the arrangement positions 15A and 15B. Note that, on the basis of the reference data, the CPU 81 may display on the LCD 31 an image showing the plurality of decorative components 16, and may highlight the display of the image of the decorative components 16A and 16B in recognition of the characteristic arrangement positions. In this case, on the basis of the display on the LCD 31, the user can easily recognize the decorative components 16A and 16B among the plurality of decorative components 16. When the plurality of decorative components 16 adhered to the transfer sheet 20 are arranged in the hole portions 19 of the holding body 18 in the process B, their positional relationships are determined by the formation positions of the hole portions 19. As a result, by arranging the decorative components 16A and 16B in the arrangement positions 15A and 15B, respectively, the respective positions of the other decorative components 16 are also determined and arranged in arrangement positions corresponding to the sewing position of the embroidery pattern 15.

When the user has completed the arrangement of the decorative components 16, the user operates the touch panel 32 and performs an operation notifying that the arrangement is complete. When the CPU 81 receives the input of the operation notifying that the arrangement is complete (yes at step S17), the CPU 81 ends the display of the mark 60 by the irradiation mechanism 57 (step S19), thus ending the marking processing. The user removes the embroidery frame 7 from the transport mechanism 6, and removes the processing cloth 73 on which the transfer sheet 20 has been arranged from the embroidery frame 7. The user carries out the heat treatment (the process F) using the iron or the like, and causes the decorative components 16 to firmly stick to the processing cloth 73. The user removes the transfer sheet 20 (the process G), and thus obtains the processing cloth 73 on which the decorated pattern 17 is formed.

As described above, according to the sewing machine 1 of the present embodiment, when the decorative components 16 are to be arranged on the processing cloth 73, the user can easily obtain the correct positional relationships of the arrangement positions of the decorative components 16 with respect to the sewing position of the embroidery pattern 15, simply by arranging the decorative components 16A and 16B adhered to the transfer sheet 20 at the arrangement positions 15A and 15B indicated by the mark 60.

Further, since the formation positions of the hole portions 19 in the holding body 18 formed on the basis of the formation data and the sewing position of the embroidery pattern 15 sewn on the basis of the embroidery data have a correct positional relationship, the user can easily arrange the decorative components 16 whose positions have been determined by the holding body 18, in the correct positions with respect to the sewing position of the embroidery pattern 15.

In addition, the user can easily arrange all of the decorative components 16 in the correct positions with respect to the sewing position of the embroidery pattern 15, simply by arranging the two decorative components 16A and 16B in the positions aligned with the end portions 60A and 60B at both sides of the mark 60.

Furthermore, the user can easily arrange the decorative components 16 in the correct positions, simply by arranging the decorative components 16 on the processing cloth 73 in alignment with the mark 60 displayed by the irradiation shape of the light.

It should be noted that the present disclosure is not limited to the above-described embodiment, and various modifications can be added. The above-described marking processing (refer to FIG. 7) is not limited to the example of being executed by the CPU 81, and may be executed by another electronic component, such as an application specific integrated circuit (ASIC) a field programmable gate array (FPGA) or the like.

Figure 9:
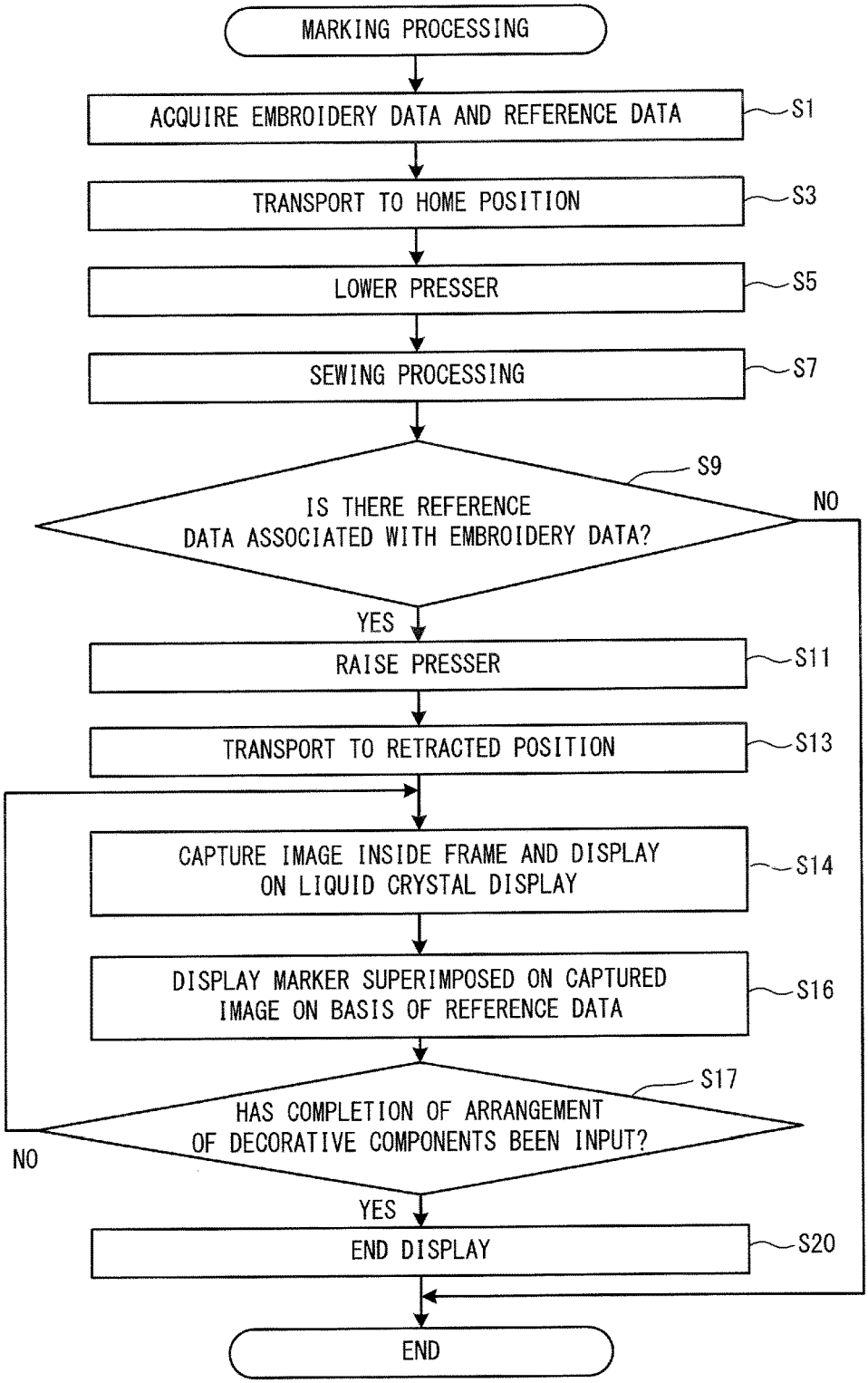
FIG. 9 is a flow chart of the marking processing according to a first modified example.

According to a first modified example of the present disclosure, in the marking processing, for example, the CPU 81 may superimpose, on the image of the embroidery pattern 15 captured by the image sensor 56, a mark image indicating positions corresponding to the arrangement positions 15A and 15B, and may display the mark image superimposed on the image of the embroidery pattern 15 on the LCD 31. For example, as shown in FIG. 9, when the embroidery frame 7 has been transported to the retracted position at step S13 of the marking processing, the CPU 81 causes the image sensor 56 to capture the image of the inside of the inner frame 71 of the embroidery frame 7 that has been transported to the retracted position. The CPU 81 displays the captured image on the LCD 31 (step S14). As described above, the coordinate system representing the coordinates of the image captured by the image sensor 56 is associated with the world coordinate system. Thus, the CPU 81 can associate positions corresponding to the arrangement positions of the decorative components 16A and 16B with positions on the captured image displayed on the LCD 31. On the basis of the reference data, the CPU 81 displays the mark image, which indicates the positions corresponding to the arrangement positions 15A and 15B of the decorative components 16A and 16B, respectively, in a superimposed manner on the captured image, on the LCD 31 (step S16). The CPU 81 displays the image on the LCD 31 to receive the input of the operation notifying the completion of the arrangement of the decorative components 16, returns the processing to step S14, and stands by for the input (no at step S17).

The user conveys the transfer sheet 20, to the bottom surface of which the plurality of decorative components 16 have been adhered in the process D (refer to FIG. 6), onto the processing cloth 73 clamped by the embroidery frame 7. An image showing the state of the transfer sheet 20 and the decorative components 16 positioned on the processing cloth 73 is captured by the image sensor 56. The captured image is displayed on the LCD 31. Note that it is assumed that the transfer sheet 20 is a transparent sheet. Further, the image is continuously captured at a predetermined interval, such as an interval of 0.1 seconds, for example, and the image is displayed on the LCD 31 each time the image is captured. Alternatively, the image may be a moving image. The user moves the transfer sheet 20 and adjusts the position of the transfer sheet 20 while looking at the LCD 31, such that the decorative components 16A and 16B overlap with the positions on the mark image indicating the decorative components 16A and 16B. The user arranges the transfer sheet 20 on the processing cloth 73 in a position at which the mark image and the decorative components 16A and 16B are displayed so as to be overlapped with each other. In this way, the decorative components 16A and 16B are arranged, respectively, on the arrangement positions 15A and 15B. The respective positions of the other decorative components 16 are also determined and arranged in the arrangement positions corresponding to the sewing position of the embroidery pattern 15. When the CPU 81 receives the input of the operation notifying that the arrangement is complete (yes at step S17), the CPU 81 ends the display on the LCD 31 (step S20). The CPU 81 ends the marking processing. The user removes the embroidery frame 7 from the transport mechanism 6, and obtains the processing cloth 73 on which the decorated pattern 17 is formed by going through the process F and the process G (refer to FIG. 6).

In this way, the user can easily arrange the decorative components 16 in the correct positions, simply by arranging the decorative components 16 on the processing cloth 73 in alignment with the mark image while looking at the display on the LCD 31.

It should be noted that, in the first modified example, in the processing at step S14, in place of the image captured of the embroidery pattern 15, the CPU 81 may create an image indicating the sewing position of the embroidery pattern 15 on the basis of the embroidery data, and may display that image on the LCD 31. In this case, in the processing at step S16, the CPU 81 may display the mark image indicating the positions corresponding to the arrangement positions 15A and 15B of the respective decorative components 16A and 16B, superimposed on the image indicating the sewing position. For example, even when the transfer sheet 20 is a non-transparent sheet and the image of the embroidery pattern 15 cannot be captured via the transfer sheet 20, the CPU 81 can display the mark image and the image indicating the sewing position superimposed on the captured image of the transfer sheet 20.

Figure 10:
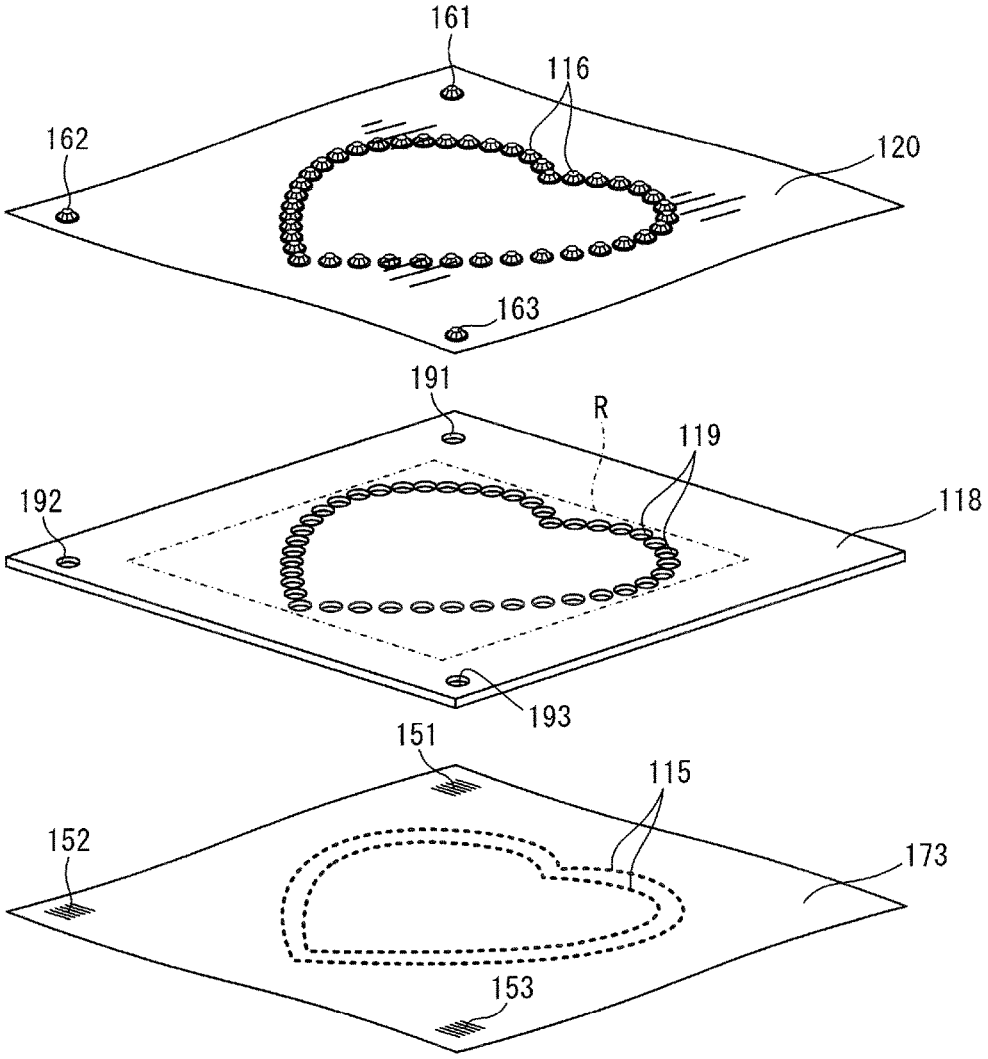
FIG. 10 is a diagram showing relationships between formation positions in a holding body, arrangement positions of decorative components, and a sewing position of the embroidery pattern according to a second modified example.

Further, according to a second modified example of the present disclosure, in the marking processing, the CPU 81 may, for example, sew stitches 151 to 153 on a processing cloth 173, which act as markers to indicate arrangement positions of decorative components 161 to 163. For example, as shown in FIG. 10, in addition to decorative components 116 used to form a decorated pattern in combination with an embroidery pattern 115, the decorative components 161 to 163 are also prepared, which are used to determine arrangement positions of the decorative components 116. The CPU of the PC 10 creates formation data, which includes first formation data representing formation positions of first hole portions 119 used to indicate the arrangement positions of the decorative components 116, and second formation data that represents formation positions of second hole portions 191 to 193 used to indicate the arrangement positions of the decorative components 161 to 163. At this time, the CPU of the PC 10 creates the second formation data such that the formation positions of the second hole portions 191 to 193 are positioned outside a minimum rectangular area R that includes all the formation positions of the first hole portions 119. In this way, when the heat treatment is carried out using the iron or the like in the process F (refer to FIG. 6), it is easy to carry out the heat treatment such that the decorative components 161 to 163 do not become firmly stuck to the processing cloth 173. In the process A (refer to FIG. 6), the cutting device 11 forms the first hole portions 119 and the second hole portions 191 to 193 in a holding body 118 in accordance with the formation data.

The CPU of the PC 10 creates reference data, which represents coordinates of positions at which the stitches 151 to 153 that act as the markers are to be sewn and which correspond to the formation positions of the second hole portions 191 to 193, and embroidery data used to sew the embroidery pattern 115, and transmits the data to the sewing machine 1. The CPU 81 of the sewing machine 1 receives the embroidery data and the reference data. The CPU 81 sends an instruction to sew the embroidery pattern 115 on the processing cloth 173 on the basis of the embroidery data. The CPU 81 further sends an instruction to sew each of the stitches 151 to 153 on the processing cloth 173 on the basis of the reference data. In this way, the markers to indicate the arrangement positions of the decorative components 161 to 163 are formed on the processing cloth 173. Note that it is preferable for the stitches 151 to 153 to be sewn in a pattern that can be easily undone from the processing cloth 173 after completion of the decorated pattern. For example, sewing is conceivable in which a distance between the needle drop points is maintained to be larger than an outer diameter of the decorative components and so on, so that the user can easily cut the pattern using scissors or the like.

In the process D, the user adheres the decorative components 116 and 161 to 163 held by the first hole portions 119 and the second hole portions 191 to 193 of the holding body 118 onto a transfer sheet 120. In the process E, the user arranges the transfer sheet 120 on the processing cloth 173 such that the decorative components 161 to 163 are placed on the stitches 151 to 153, respectively. In the process F, the user carries out the heat treatment on the decorative components 116 such that the decorative components 161 to 163 are not heated. In the process G, when removing the transfer sheet 120, the user can recover the decorative components 161 to 163 that are not firmly stuck to the processing cloth 173. The user uses scissors or the like to undo the stitches 151 to 153, and can thus obtain the processing cloth 173 on which only the decorative components 116 are firmly stuck to the processing cloth 173 and on which the decorated pattern is formed in combination with the embroidery pattern 115.

In this way, the user can easily arrange the decorative components 116 in the correct positions on the processing cloth 173, simply by arranging the decorative components 161 to 163 in alignment with the stitches 151 to 153 that act as the markers.

Further, the sewing machine 1 can use the arrangement positions corresponding to the second hole portions 191 to 193, which differ from the first hole portions 119 used to arrange the decorative components 116 corresponding to the embroidery pattern 115, to determine the positions of the decorative components 161 to 163. As a result, the user can simply arrange the decorative components 161 to 163 corresponding to the second hole portions 191 to 193 in alignment with the stitches 151 to 153, irrespective of the overall shape formed by the decorative components 116. In this way, the user can easily arrange all of the decorative components 116 in the correct positions with respect to the sewing position of the embroidery pattern 115.

In addition, the formation positions of the second hole portions 191 to 193 are positioned outside the minimum rectangular area R that includes all the formation positions of the first hole portions 119. Thus, the user easily arranges the decorative components 161 to 163 corresponding to the second hole portions 191 to 193 in alignment with the stitches 151 to 153. As a result, the user can easily arrange all of the decorative components 116 in the correct positions with respect to the sewing position of the embroidery pattern 115. Further, the decorative components 116 corresponding to the first hole portions 119 are arranged away from the decorative components 161 to 163 corresponding to the second hole portions 191 to 193. Thus, the user easily performs the operation to firmly stick the decorative components 116 corresponding to the first hole portions 119 onto the processing cloth 173 by the heat treatment using the iron or the like.

In the second modified example, the stitches 151 to 153 may be formed in a cross shape, for example, and it is sufficient that the stitches 151 to 153 can be used to indicate the arrangement positions of the decorative components 161 to 163. Further, in the second modified example, the stitches 151 to 153 may be sewn that have a bottom surface area larger than that of each of the decorative components 161 to 163, and that can completely cover the bottom surface of each of the decorative components 161 to 163, and may display the stitches 151 to 153 as the markers. In this case, in the process F, the user may carry out the heat treatment on the decorative components 116 including the decorative components 161 to 163. As a result of the heat treatment, the bottom surfaces of the decorative components 116 are firmly stuck to the surface of the processing cloth 173. Further, the bottom surfaces of the decorative components 161 to 163 are firmly stuck to the stitches 151 to 153, respectively. Thus, by undoing the stitches 151 to 153, the user can remove the decorative components 161 to 163 from the processing cloth 173 along with the stitches 151 to 153.

Figure 11:
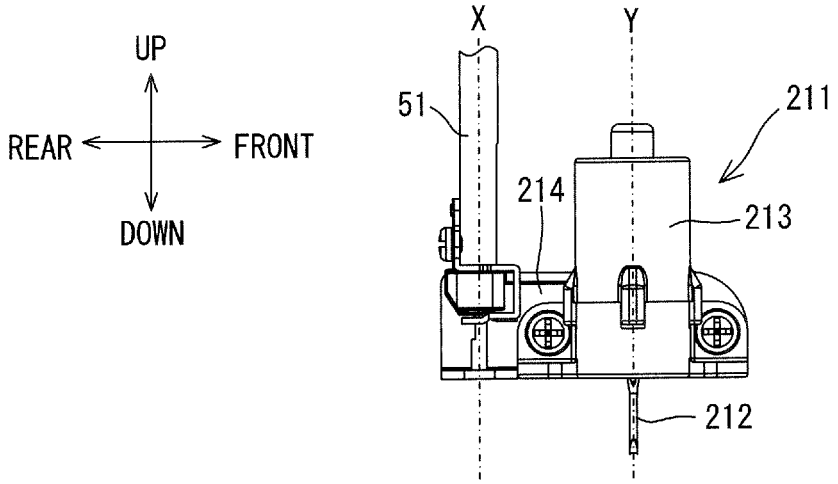
FIG. 11 is a left side view of a cutting needle device according to a third modified example.

According to a third modified example of the present disclosure, the sewing machine 1 may be provided with a formation portion that can form the hole portions 19 in the holding body 18. For example, as shown in FIG. 11, a cutting needle device 211 is mounted on the needle bar 51 of the sewing machine 1. The cutting needle device 211 is provided with a cutting needle 212 that can form the hole portions 19 in the holding body 18. The cutting needle 212 extends in a rod shape in the up-down direction, and a blade tip of a predetermined width is formed on the leading end portion (the lower end portion) thereof. The cutting needle device 211 is provided with a main body portion 213 and an attachment portion 214. The main body portion 213 supports the base end portion of the cutting needle 212, in a state in which the leading end portion of the cutting needle 212 is caused to protrude downward from the lower end of the main body portion 213.

The cutting needle device 211 is fixed to the needle bar 51 by the attachment portion 214 being fixed to the needle bar 51 on which the sewing needle 52 is not mounted. In the state in which the cutting needle device 211 is fixed to the needle bar 51, a position of a center axis Y of the cutting needle 212 is a position that is offset, by a predetermined distance to the front, with respect to a position of a center axis X of the needle bar 51. Thus, the home position of the formation coordinate system of the formation data may be set as a position that is displaced from the home position of the embroidery coordinate system of the embroidery data by a distance corresponding to the offset.

When forming the hole portions 19 in the holding body 18, the user fixes the cutting needle device 211 to the needle bar 51, and attaches the holding body 18 to the frame holder 63 of the transport mechanism 6, via an attachment component, for example. The CPU 81 of the sewing machine 1 drives the X-axis motor 65 and the Y-axis motor 64 on the basis of the formation data, and transports the holding body 18 using the transport mechanism 6. Further, in line with the above-described transportation, the CPU 81 of the sewing machine 1 drives the sewing machine motor 33 on the basis of the formation data, and moves the needle bar 51, to which the cutting needle device 211 is fixed, up and down. As a result, the cutting needle 212 can cut the holding body 18 and create a plurality of circular notches, and can thus form the plurality of hole portions 19. It should be noted that the cutting needle 212 may have, for example, a punch-shaped blade tip that can form the hole portion 19 having a diameter slightly larger than the outer diameter of the decorative component 16. In this way, after forming the hole portions 19 in the holding body 18 using the cutting needle device 211 and mounting the sewing needle 52 on the needle bar 51 by the user, the CPU 81 may perform the marking processing in a similar manner to the above-described embodiment.

In this way, the sewing machine 1 forms the hole portions 19 by forming openings rather than by forming recessed portions in the holding body 18, using the cutting needle 212 of the cutting needle device 211, and it is thus easy to adjust an amount of pressure required to form the hole portions.

According to a fourth modified example of the present disclosure, characteristic decorative components used for reference data are not limited to two, and may be three or more. In this case, the CPU of the PC 10 may determine positions of the formation positions of the hole portions 19 formed in the holding body 18 corresponding to arrangement positions of the three or more decorative components such that a polygonal shape (a triangle in the case of three characteristic decorative components), for which each of the formation positions is an apex, is a non-equilateral polygonal shape (a non-equilateral triangle in the case of the three characteristic decorative components). With this configuration, when determining the arrangement positions of the characteristic decorative components on the basis of the mark 60, the user can easily identify an orientation of the decorative components 16 in a plane direction.

Further, according to a fifth modified example of the present disclosure, the CPU 81 of the sewing machine 1 may execute a program similar to the application executed by the CPU of the PC 10, and may create embroidery data, formation data and reference data. For example, the CPU 81 displays, on the LCD 31, an image showing the embroidery pattern 15, receives operation of the touch panel 32 by the user, and edits the shape of the embroidery pattern 15. On the basis of editing results, the CPU 81 may create the embroidery data to form the embroidery pattern 15. Further, the CPU 81 displays an image showing the decorative components 16 on the LCD 31, receives operation of the touch panel 32 by the user, and determines the positional relationships between the decorative components 16. The CPU 81 may create the formation data used to form the hole portions 19 in the holding body 18, on the basis of the positional relationships between the decorative components 16. The CPU 81 may further create the reference data on the basis of sewing data and the formation data, in a similar manner to the above-described embodiment. Further, the sewing machine 1 may be connected to the cutting device 11 via a USB cable and may transmit the formation data to the cutting device 11. Alternatively, as in the above-described third modified example, the sewing machine 1 may cause the cutting needle device 211 to be mounted on the needle bar 51 and may form the hole portions 19 in the holding body 18 on the basis of the formation data.

According to a sixth modified example of the present disclosure, the irradiation mechanism 57 may be able to form a cross mark, for example, rather than simply forming the linear mark 60 that is formed by spreading the red light in the front-rear direction.

Further, in the above-described embodiment, the rhinestones are given as the example of the decorative components 16, but the decorative components 16 are not limited to the rhinestones. For example, applique or emblems may be applied to the present disclosure as the decorative components 16, which may be studs (iron on studs) that can be adhered to a cloth or the like by heating using an iron or the like, may be lace (lace applique) or may be a transfer sheet (an iron print sheet) or the like. Further, the decorative components 16 need not necessarily be adhered to the processing cloth 73 using the iron or the like. For example, the decorative components 16 may simply be held on the processing cloth 73 using surface fasteners or the like. Alternatively, the decorative components 16 may be positioned on the embroidery pattern 15 using the present disclosure, and may be fixed to the processing cloth 73 using hot bond or the like. Alternatively, beads or buttons etc. may be adopted as the decorative components 16 and positioned on the embroidery pattern 15 using the present disclosure. After that, the beads or buttons etc. may be sewn onto and thus fixed to the processing cloth 73. Further, the number of the decorative components 16 is not limited to the plurality.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a sewing portion configured to sew a pattern on a sewing object;

a processor; and a memory storing non-transitory computer-readable instructions that, when executed by the processor, perform the processes of:

acquiring reference data representing a relative positional relationship between a sewing position and a plurality of arrangement positions, the sewing position being a position of the pattern sewn on the sewing object by the sewing portion, the arrangement position being a position of a plurality of decorative components arranged on the sewing object; and displaying, on the basis of the acquired reference data, a mark that indicates the arrangement position corresponding to the sewing position, wherein the plurality of the decorative components are arranged in the plurality of the arrangement positions in a state in which positions between the plurality of the decorative components are determined on the basis of a plurality of hole portions formed in a holding body, and wherein the reference data represents relative positional relationships between the sewing position and formation positions of the plurality of hole portions formed in the holding body.

2. The sewing machine according to claim 1, wherein the displaying the mark includes displaying the mark indicating the plurality of the arrangement positions corresponding to the formation positions of at least two of the plurality of hole portions formed in the holding body.

3. The sewing machine according to claim 2, wherein the displaying mark includes displaying the mark indicating the plurality of the arrangement positions corresponding to the formation positions of at least three of the plurality of hole portions formed in the holding body, the formation positions of the at least three hole portions having a positional relationship such that a virtual polygonal shape having each of the formation positions as an apex is a non-equilateral polygonal shape.

4. The sewing machine according to claim 1, wherein the non-transitory computer-readable instructions, when executed by the processor, further perform the process of:

acquiring formation data representing the formation positions, the formation data including first formation data and second formation data, the first formation data representing the formation positions of at least one first hole portion corresponding to the plurality of the arrangement positions of the plurality of the decorative components, the at least one first hold portion being included in the plurality of hole portions formed in the holding body, the second formation data representing, on the basis of the reference data and the formation positions of the at least one first hole portion, the formation positions of second hole portions used to indicate the plurality of the arrangement positions, the second hole portions being included in the plurality of hole portions formed in the holding body, the sewing machine further comprises:

a formation portion configured to form the plurality of hole portions in the holding body on the basis of the acquired formation data, the formation portion forming the plurality of hole portions in the holding body on the basis of the first formation data and the second formation data, the reference data includes the second formation data, and the displaying the mark includes displaying the mark indicating the plurality of the arrangement positions corresponding to the formation positions of the second hole portions, on the basis of the second formation data included in the reference data.

5. The sewing machine according to claim 4, wherein the formation positions of the second hole portions represented by the second formation data are positioned outside a minimum rectangular area that includes all of the formation positions of the at least one first hole portion represented by the first formation data.

6. The sewing machine according to claim 4, wherein the formation portion configured to form the plurality of hole portions by cutting the holding body at the formation positions in accordance with a shape of each of the plurality of hole portions.

7. The sewing machine according to claim 1, further comprising:

an image capture portion configured to capture an image of the sewing object; and a display portion configured to display the image of the sewing object captured by the image capture portion, wherein the displaying the mark includes controlling the display portion and displaying a mark image representing the mark so as to be superimposed at a position on the image of the sewing object corresponding to a display position of the mark on the sewing object.

8. The sewing machine according to claim 1, further comprising:

an irradiation portion configured to irradiate light toward the sewing object, wherein the displaying the mark includes controlling the irradiation portion and causing light representing the mark to be irradiated onto the sewing object, using an irradiated shape, at a display position of the mark.

9. The sewing machine according to claim 1, wherein

The displaying the mark includes controlling the sewing portion and causing a stitch to be sewn as a marker representing the mark, at a display position of the mark on the sewing object.

* * * * *